US005481812A

United States Patent [19]

Pedano

[11] Patent Number: 5,481,812

[45] Date of Patent: Jan. 9, 1996

[54] SPACING TOOL FOR WALL CONSTRUCTION

[76] Inventor: Michael Pedano, 33 Glen Roy Rd. S., Fairfield, N.J. 07004

[21] Appl. No.: 260,950

[22] Filed: May 16, 1994

[51] Int. Cl.[6] ..... G01B 3/30

[52] U.S. Cl. ..... 33/613; 33/518; 33/526

[58] Field of Search ..... 33/613, 518, 526, 33/527, 533, 645, 651, 16; 52/127.1, 127.5, 127.7, 604, 749, DIG. 1

[56] References Cited

U.S. PATENT DOCUMENTS

| | | | |
|---|---|---|---|
| 915,982 | 3/1909 | Maddux . | |
| 1,068,983 | 7/1913 | Coulthurst | 33/533 |
| 1,312,309 | 8/1919 | Dietrichs | 52/604 |
| 2,543,716 | 2/1951 | Carini . | |
| 2,679,745 | 6/1954 | Bartram . | |
| 2,693,033 | 11/1954 | Acker, Jr. et al. . | |
| 2,760,272 | 8/1956 | Van Cantie . | |
| 3,174,227 | 3/1965 | House . | |
| 3,195,266 | 7/1965 | Onanian | 52/DIG. 1 |
| 4,327,493 | 5/1982 | Dickerson . | |
| 4,408,398 | 10/1983 | Glaze . | |
| 4,606,110 | 8/1986 | Goserud | 33/613 |
| 5,095,633 | 3/1992 | Barnett . | |
| 5,303,481 | 4/1994 | Russell | 33/533 |

FOREIGN PATENT DOCUMENTS

| | | | |
|---|---|---|---|
| 575360 | 2/1946 | United Kingdom | 33/645 |

*Primary Examiner*—Christopher W. Fulton
*Attorney, Agent, or Firm*—Thomas L. Adams

[57] ABSTRACT

A spacing tool for the construction of gravity wall retaining systems which utilize the mortarless pinned connection of building units containing alignment holes on their upper and lower surfaces. A pair of parallel tines, of circular cross section, are separated by a distance which is determined by the location of the alignment holes on the upper and lower surfaces of building units. A spacing bar is connected to each tine and is formed from the same continuous circular cross-section material as the tines. A U-shaped bracket, having upright members and a lateral member is attached to the spacing bar in a position opposite the tines. A handle is located between the upright members of the bracket and attached thereto.

22 Claims, 2 Drawing Sheets

SPACING TOOL FOR WALL CONSTRUCTION

FIELD OF THE INVENTION

The present invention relates to a spacing tool for wall construction, and in particular, to a tool adapted to the construction of retaining walls with masonry units designed for pinned connections to provide a structurally interlocked network.

DESCRIPTION OF RELATED ART

Numerous tools have been developed for building walls with building blocks. The most common are rectangular blocks, sometimes with hollows spanned by webs. These blocks are laid on a bed of mortar and then adjusted to determine their relative position. Applying the proper amount of mortar under and between adjacent blocks requires much experience and skill. A variety of tools have been developed to facilitate this activity.

Another type of block is mortarless and has cavities or bores for holding pins that interlock between successive courses of blocks. An example of such blocks are those sold by Keystone Retaining Wall Systems, Inc., Minneapolis, Minn. When such blocks are used to form a curved retaining wall the space between adjacent blocks varies with the radius of curvature and the type of curvature (convex/concave).

U.S. Pat. No. 4,408,398 (J. R. Glaze) shows a gage for laying blocks and employs spacers whose diameter equals the desired thickness of mortar. The spacers are fastened perpendicularly to a handle to control mortar underneath and alongside the blocks. A positioning guide parallel to the handle engages the exposed face of a block in an adjacent course. After a new block is laid, the spacers are removed and a striker tool is used to close voids left in the mortar by the spacers. The gage is not adapted to engage cavities on the blocks or account for variations in interblock spacing caused by variations in wall curvature.

U.S. Pat. No. 3,174,227 (W. R. House) shows a block and brick laying kit with similar disadvantages. This reference shows tines attached to one side of a trowel to provide a position guide for vertical interblock spacing. Similar disadvantages are found in U.S. Pat. No. 2,543,716 (J. A. Carini), which shows a block laying guide having inserts for setting the mortar thickness underneath and to one side of a block.

U.S. Pat. No. 5,095,633 (B. R. Barnett) shows a device for laying blocks employing two dependent legs that diverge at a slight angle and are capable of straddling a web of a block in the underlying course. A horizontal pivot arm has an adjustable length for contacting and positioning a block being laid.

U.S. Pat. No. 2,679,745 (D. E. Bartram) shows a brick and mortar jointer employing an angle iron resting upon a lower course for controlling the vertical depth of mortar and multiple spacers for controlling the thickness of mortar between blocks on the next higher course.

U.S. Pat. No. 915,982 (C. Maddux) shows a gage for spacing apart concrete blocks where a spacer shaped like a window frame clamps over a web of the last block. The thickness of the frame controls the thickness of the mortar in the direction of the course being laid. See also U.S. Pat. Nos. 915,982; and 2,760,272.

U.S. Pat. Nos. 2,693,033 (H. W. Acker) and 4,327,493 (L. R. Dickerson) show devices for measuring the distance between holes in the same workpiece. These are frail measuring instruments that are not adapted for insertion into adjacent building blocks for spacing them.

Accordingly, there is a need for a tool for locating blocks that have aligning cavities in either a straight or curved line.

SUMMARY OF THE INVENTION

The present invention relates to a spacing tool for wall construction. An advantage provided by the spacing tool is improving the accuracy of the placement of each building unit along the course of a wall.

A further advantage is enhancing the speed of placement of the building units in a course while maintaining accuracy.

An additional advantage is maintaining the proper spacing, or pitch, along a curved wall where centerlines of adjacent building units are at an angle to each other.

In accordance with the illustrative embodiments demonstrating features and advantages of the present invention, there is provided a spacing tool for construction utilizing building units having at least one alignment hole upon their surface. The spacing tool has a pair of insertion means, each having a first end and a second end, for fitting the first end into the alignment hole. The spacing tool also has a spacing means for spanning said pair of insertion means and setting the spacing therebetween.

Also a method according to the same invention can construct masonry walls with building units having alignment holes. The method employs a spacing tool having two spaced tines. The method includes the step of placing a first building unit into a predetermined position. Another step is laying a second building unit adjacent to the first building unit. The method also includes the step of checking the distance between the first and the second building units by attempting to insert the tines of the spacing tool into alignment holes of said first and second building units.

The preferred insertion means are tines adapted to fit into alignment holes formed in the upper and lower surfaces of each building unit. The distance between these tines is determined by a spacing bar such that when one tine is placed in an alignment hole atop one building unit, the other tine will keep an adjacent building unit at a predetermined distance. When the second tine is placed in an alignment hole of the adjacent building unit, that unit is at the proper pitch designated by the manufacturer of the unit. The second unit may then be swung and rotated according to the curvature required by the design of the wall.

In one embodiment of the invention, the tines are cylindrical and the spacing means includes a rigid spacing bar to keep the tines parallel and separated by a predetermined distance. To simplify construction of the tool, the tines and the spacing bar are made from one piece of round stock. To facilitate use, a handle can be added to the spacing bar. In a simple embodiment, this handle is coaxial with the spacing bar. A tool of the foregoing type can improve the speed and accuracy of placement of building units.

In another embodiment, a bracket is attached to the spacing bar by any convenient means such as: adhesive bonding, welding, or the use of fasteners. A handle is attached to the bracket by any of the aforementioned means.

In a preferred embodiment, the tines and spacing bar are made from cold rolled steel rod and the bracket is metal in the shape of an inverted U which is welded to the spacing bar. A handle is interposed between the upright portions of the bracket and secured with screws.

The spacing tool can be used during the construction of a gravity wall retaining system utilizing mortarless pinned connection of building units having alignment holes on their upper and lower surfaces. Preferably, a worker places a first building unit into a position determined by the desired course of the wall. Next, the worker moves a second building unit into an approximate position adjacent to the first building unit. The distance between the first and the second building units is checked by inserting tines of a spacing tool into alignment holes in each building unit. If the position of the second building unit does not permit the insertion of the tines, the second building unit is adjusted until they do.

For curved walls, the second building unit is moved into an approximate position adjacent to the first building unit, such that front to back centerlines of the building units intersect in a position which approximates the radius of curvature of the wall. A check of the distance is made as before, and if the position does not permit the second tine to be inserted, the position of the second building unit is adjusted so that the tines of the spacing tool fit into alignment holes in each adjacent building unit. The angular orientation of the second building unit may also be adjusted such that its centerline intersects the centerline of the first building unit at approximately the radius of curvature of the planned wall. After removing the tines, the process is repeated.

BRIEF DESCRIPTION OF THE DRAWINGS

The above description as well as other features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
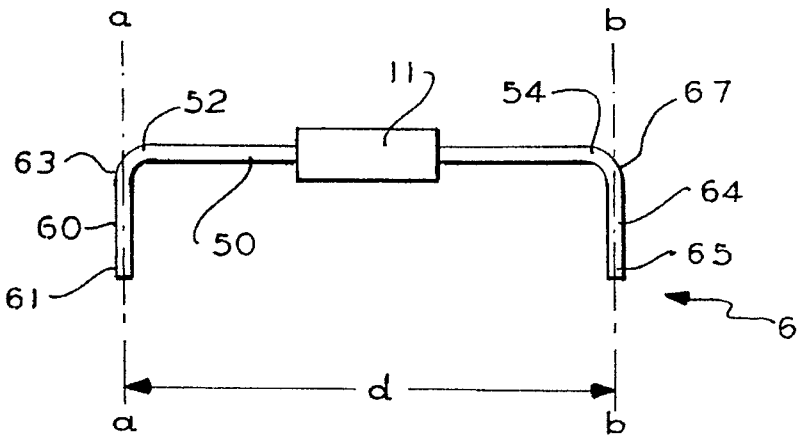
FIG. 1 is a side view of one embodiment of the present invention.

Referring to FIG. 1, spacing tool 6 comprises first insertion means 60 and second insertion means 64, which are spaced apart by a predetermined distance, d. Each insertion means has first ends 61 and 65, respectively, and second ends 63 and 67, respectively. The insertion means may be made from any rigid material whose cross-section is adapted to fit in the alignment holes that are provided on the upper and lower surfaces of the building units to be described presently.

Spacing means 50 has a first end 52 and a second end 54. The second end of the first insertion means is connected to the first end of the spacing means, and the second end of the second insertion means is connected to the second end of the spacing means.

The spacing means may be formed from any rigid material and its cross-section may be round, rectangular, or polygonal. Connection between the opposite ends of the spacing means and the second ends of the insertion means may be made by adhesive bonding, welding, or with a variety of fasteners such as staples, screws, nuts and bolts, or other devices or procedures which are well known in the art.

In one embodiment, insertion means 60 and 64 and spacing means 50 are all formed from a single piece of 0.50 inch (1.27 cm) diameter cold rolled steel. Second ends 63 and 67 of the insertion means are merged with the first and second ends 52 and 54, respectively, of the spacing bar to form a bend radius of about one inch (2.54 cm). The spacing, d, between centerline a—a of insertion means 60 and centerline b—b of insertion means 64 is determined by the specifications of the building unit. For one manufacturer this distance is 12 inches.

Additional features may be added to the basic spacing tool described above. For example, a handle may be added to the spacing means 50 to lessen the stress on a worker from repetitive use of the spacing tool. One embodiment of this feature is handle 11 of FIG. 1. This handle, mounted coaxially on spacing means 50, serves to improve the grip of the worker, and acts as a spacer to keep spacing means 50 above the upper surface of adjacent building units so that the tool may be more easily removed after the second unit is located with respect to the first. Handle 11 is typically made of wood, metal, plastic, an organic material and may be fastened by any of the means discussed above.

Figure 2:
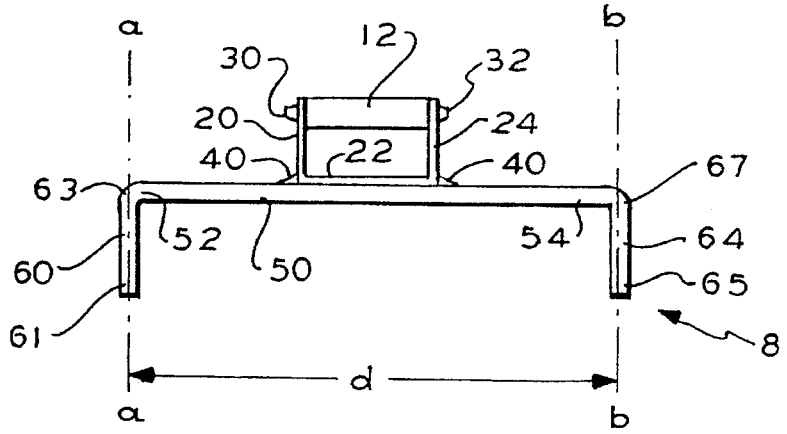
FIG. 2 is a side view of another embodiment of the present invention.

Referring now to FIG. 2, there is shown a preferred embodiment of the spacing tool. Tool 8 of FIG. 2 is similar to spacing tool 6 of FIG. 1, where corresponding elements in each figure bear the same reference number. In these instances, the discussion relating to FIG. 1 regarding the operation of each element and the cooperation between the elements is incorporated into the discussion of FIG. 2 by reference.

A U-shaped bracket comprising upright members 20 and 24 and lateral member 22 is attached to spacing bar 50 by welds 40. Handle 12 is positioned between the upright members of the bracket and is secured to the bracket by fasteners 30 and 32.

In this preferred embodiment, tines 60, 64 and spacing bar 50 are made from one piece of 0.50 inch (1.27 cm) diameter cold rolled steel with a bend radius of one inch between the tines and the spacing bar. The tines are parallel to each other and extend approximately 2.5 inches (3.81 cm) below the lower surface of the spacing bar. The separation between the tines is determined by the specifications of the building unit, described below, and is 12 inches (30.5 cm) in this application.

The bracket is made of sheet metal whose thickness may range from 0.065 inches (0.16 cm) to 0.25 inches (0.61 cm) and its width may range from 0.125 inches (0.32 cm) to 0.50 inches (1.27 cm). The upright members are approximately 2.5 inches high (6.35 cm) and the lateral member of the bracket is about 4.25 inches (10.8 cm) long. The bracket is secured to the center of the spacing bar by welds 40. The handle is wood with a length of about 4.25 inches (10.8 cm) and a diameter of about 1.25 (3.18 cm) inches. The handle is fastened to the bracket by screws or a pin thereby positioning its lower surface 1.25 inches (3.18 cm) above lateral member 22.

Figure 3:
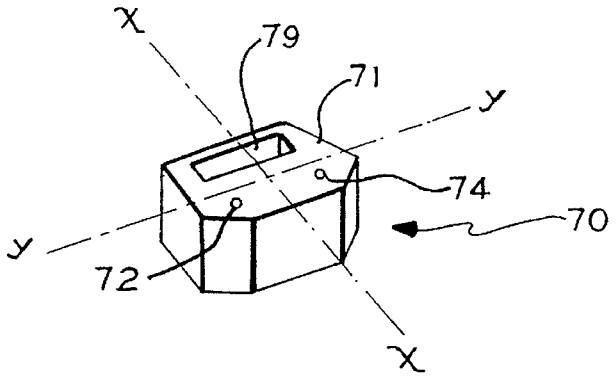
FIG. 3 is a perspective view of a building unit for use with the present invention.

Referring now to FIG. 3, an exemplary building unit 70 for the construction of gravity wall retaining systems and the like, utilizes mortarless pinned connections between successive courses of building units. These units are marketed by Keystone Retaining Wall Systems, Inc. of Minneapolis, Minn. using the trademark "Keystone Retaining Wall Systems." Each unit weighs about 90 pounds and has an upper surface with cylindrical alignment holes 72 and 74. The holes are designed to receive pins (not shown) of 0.50 inch (1.27 cm) diameter. The holes can vary in depth depending on the length of the pin, from approximately 5 inches (20.76 cm) to 9 inches (22.86 cm). The lower surface of each building unit (not shown) is symmetrical to the upper surface. Each unit 70 may have an additional aperture 79 to lessen weight and to provide drainage.

Each unit may be considered to have front to back axis x—x and orthogonal axis y—y. For a straight wall the y—y axes of each building unit will be coincident. For curved walls, however, the x—x axes of adjacent building units will intersect at an angle.

It is an advantage of this invention to provide rugged tines of approximately the same diameter as the pins provided by the manufacturer, said tines being spaced apart by a distance which will ensure the proper location of each building unit with respect to an adjacent one along a course. This relationship is important because the next higher course spans two adjacent building units from the lower course, and the pins which are placed in and protrude from the alignment holes of the lower unit must fit into the alignment holes in the lower surface to the upper unit. The spacing tool provides a particular benefit in the construction of curved walls, as described below.

Figure 4:
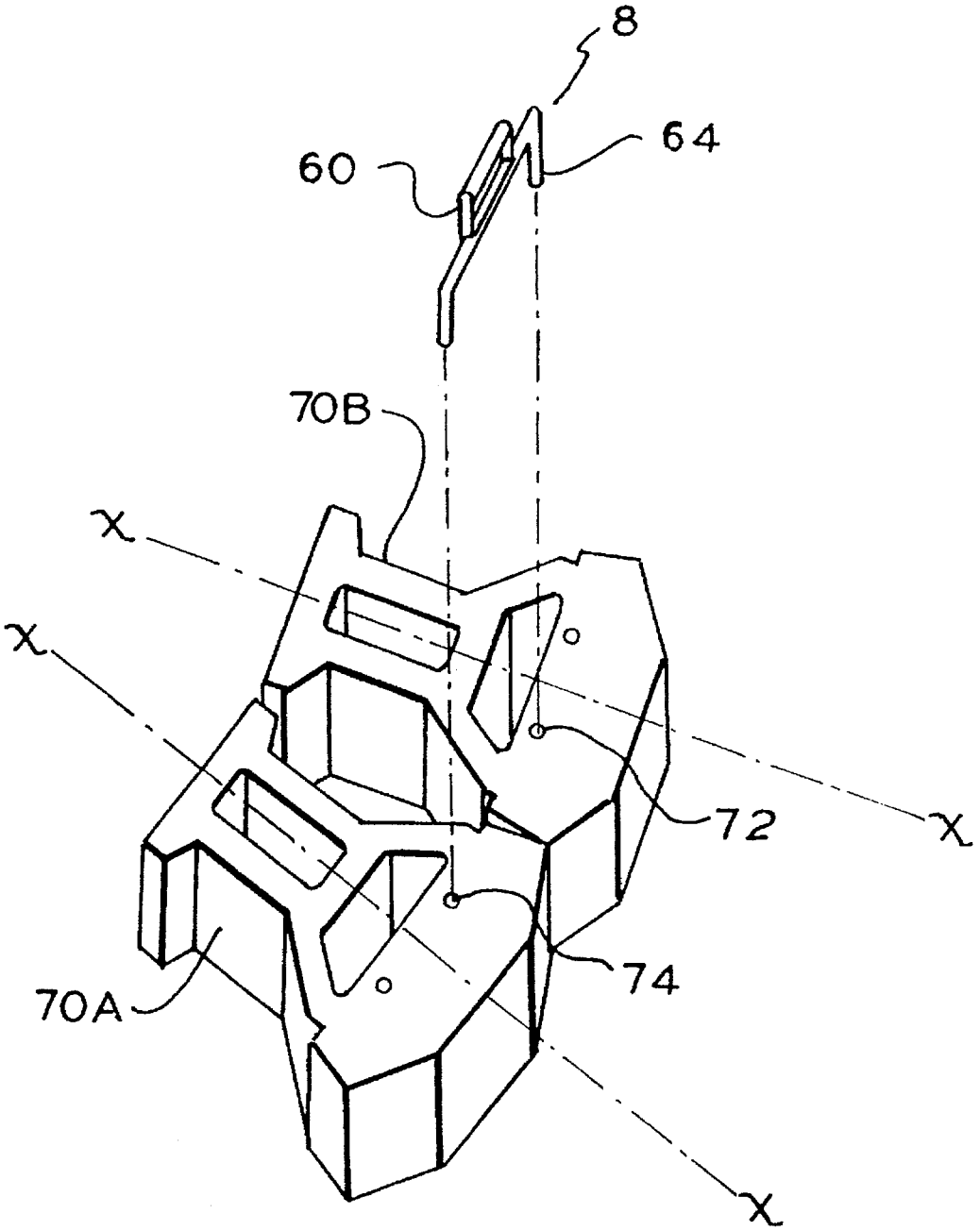
FIG. 4 is perspective view of two building units in relation to the spacing tool of the present invention.

Referring now to FIG. 4, building units 70A and 70B are aligned to form a curved wall. Each unit has a front to back centerline, x—x, which is at a slight angle to the adjacent unit's axis. Spacing tool 8 is shown positioned above alignment holes 72 and 74.

A gravity wall retaining system is constructed by following these steps: A first building unit 70A is placed into its position upon base soil as specified by the manufacturer of the unit, a second unit 70B is moved into an approximate position which is parallel and adjacent to the first building unit 70A. The distance between the first and the second building units is checked by attempting to insert tines 60, 64 of spacing tool 8 into alignment holes 72, 74 in each building unit.

If the initial position of the second building unit 70B does not permit the insertion of the tines 60, 64, the second building unit 70B is adjusted so that the tines fit into alignment holes 72, 74 in each adjacent building unit.

For curved walls, the second building unit 70B is moved into an approximate position which is adjacent to the first building unit 70A, such that centerlines x—x of the building units intersect approximately at the center of the radius of curvature of the wall. A check of the inter-unit distance is made as before, and if the positioning does not permit insertion of the second tine 64, the position of the second building unit 70B is adjusted so that the tines of 60, 64 of spacing tool 8 fit into alignment holes 72, 74 in each adjacent building unit. The angular orientation of the second building unit 70B may then also be adjusted such that its centerline intersects the centerline of the first building unit at approximately the center of the radius of curvature of the wall. The angular orientation may not be measured per se, but the angle may be inherently set by moving the blocks to follow a curved outline that may have been laid out in advance. For a curved wall, spacing tool 8 holds the pitch constant for the alignment holes, while the angular orientation between them is adjusted. This is one of the particular advantages in using the spacing tool.

The tool 8 and its tines 60, 64 are then removed and the process of laying blocks to form a course is repeated. Pins are next inserted into appropriate alignment holes 72, 74 and the second course is placed over the first with pins P connecting between the topside of blocks in a lower course to the underside of blocks in the next higher course. The blocks in the next higher course are laid to overlap two lower blocks at their joint.

Changes or modifications in the specifically described embodiments can be carried out without departing from the scope of the invention. For example, the spacing means may be flexible, such as a rope or a chain that determines the maximum spacing between the insertion means. Also, the insertion means may be in the shape of hooks. The illustrated bracket can be a simple upright member, a pair of upright members, or the bracket and handle can be formed from a continuous piece of material and attached, as noted, to the spacing bar. The elements in each embodiment may also be made from a variety of materials and processes including casting or molding.

Obviously, many modifications and variations of the present invention are possible in light of the above teachings. It is therefore to be understood that within the scope of the appended claims, the invention may be practiced otherwise than as specifically described.

I claim:

1. A spacing tool for construction utilizing building units having at least one alignment hole upon their surface comprising:

a parallel pair of smooth insertion means held in a fixed position, each having a first end and a second end, for fitting the first end into said alignment hole, each of said insertion means having a length exceeding its width; and spacing means for spanning said pair of insertion means and setting the spacing between two of said building units, said spacing means including:

(a) a spacing bar; and (b) a handle attached to said spacing bar and having an opening between said handle and said spacing bar sized to allow fingers to curl under said handle between said handle and said spring bar, said handle and said insertion means being on opposite sides of said spacing bar, said handle being positioned to allow single handed gripping of said spacing tool at a position between and proximal to said second ends and approximately coplanar with said insertion means.

2. The spacing tool of claim 1 wherein said pair of insertion means each include a cylindrical portion.

3. The spacing tool of claim 2 wherein the spacing means is formed from a rigid material.

4. The spacing tool of claim 1 wherein said handle is mounted parallel to the spacing means.

5. The spacing tool of claim 1 comprising a bracket attached between the spacing means and said handle.

6. The spacing tool of claim 5 wherein said spacing means and said pair of insertion means are integral.

7. The spacing tool of claim 5 wherein said pair of insertion means, said spacing means, and said handle have coplanar centerlines.

8. The spacing tool of claim 3 wherein the second end of each of said insertion means is attached to the spacing means.

9. The spacing tool of claim 8 wherein said pair of insertion means and said spacing means each have a cylindrical cross-section.

10. The spacing tool of claim 9 wherein the cylindrical portions of said pair of insertion means are spaced to simultaneously reside in alignment holes of adjacent ones of said building units to keep them separated by a predetermined distance.

11. A spacing tool according to claim 1 wherein said pair of insertion means comprise a pair of parallel tines.

12. The spacing tool of claim 11 wherein the tines, spacing bar, and handle have coplanar centerlines.

13. The spacing tool of claim 12 wherein the tines and the spacing bar are formed from a continuous piece of material.

14. The spacing tool of claim 13 comprising:

a bracket having two upright members projecting from said spacing bar, said handle being attached between said upright members.

15. The spacing tool of claim 13 wherein the handle comprises a cylindrical grip and a coaxial pin attached to said bracket.

16. The spacing tool of claim 12 wherein the tines are spaced to simultaneously reside in alignment holes of adjacent ones of said building units to keep them separated by a predetermined distance.

17. A spacing tool for the construction of gravity wall systems which utilize a mortarless pinned connection of building units having at least one alignment hole on their upper surface comprising:

a first and a second tine, each being of circular cross-section and each having a first end, a second end, and a centerline, being spaced apart such that the centerlines lie in a plane and are parallel to each other, the centerlines being separated by a distance which is determined by the location of an alignment hole in the upper surface of building units;

a spacing bar, lying in the plane of the centerlines of the tines, being perpendicular to them, being formed from the same continuous circular cross-section material as the tines, such that the spacing bar maintains the tines parallel to each other and separated by a predetermined distance;

a bracket, having upright members and a lateral member, formed in the shape of a U, being located in the plane of the tines and being attached to the spacing bar in a position opposite to the tines; and a handle, being located between the upright members of the bracket and attached thereto, said handle being positioned to provide an opening between said handle and said spacing bar sized to allow fingers to curl under said handle between said handle and said spacing bar, said handle and said tines being on opposite sides of said spacing bar.

18. A method for the construction of masonry walls with building units having alignment holes for holding alignment pins and by using a spacing tool having two spaced tines, comprising the steps of:

placing a first building unit into a predetermined position;

laying a second building unit adjacent to the first building unit;

checking the distance between the first and the second building units by inserting the tines of the spacing tool into alignment holes of said first and second building units and removing said tines from the alignment holes;

overlaying said first and second building units by:

(a) inserting the alignment pins into alignment holes of said first and second building units, and (b) placing a third building unit over said first and second building unit without repositioning said first and second building units.

19. The method of claim 18 comprising the step of changing the position of the second building unit until the tines of the spacing tool fit into alignment holes in the first and second building unit.

20. The method of claim 19 wherein the building units have a front to back centerline and wherein the step of laying the second building unit adjacent the first building unit is performed with the front to back centerlines of said first and second building units skewed.

21. The method of claim 20 wherein the step of laying the second building unit adjacent the first building unit is performed to keep successive building units along an outline following a predetermined radius of curvature having a center of curvature, and to orient the front to back centerlines of said first and second building units to intersect at the center of curvature of said radius of curvature.

22. The method of claim 21 wherein angular orientation of the second building unit is adjusted while its position is restrained by one tine of the spacing tool.

* * * * *